US008387323B2

(12) United States Patent
Mickelson

(10) Patent No.: US 8,387,323 B2
(45) Date of Patent: Mar. 5, 2013

(54) ARTIFICIAL STONE SIDING PRODUCT

(75) Inventor: Richard A. Mickelson, Eau Claire, WI (US)

(73) Assignee: Silvermine Stone Company, Eau Claire, WI (US)

( * ) Notice: Subject to any disclaimer, the term of this patent is extended or adjusted under 35 U.S.C. 154(b) by 301 days.

(21) Appl. No.: 12/283,115

(22) Filed: Sep. 9, 2008

(65) Prior Publication Data

US 2009/0113837 A1 May 7, 2009

Related U.S. Application Data

(60) Provisional application No. 60/984,802, filed on Nov. 2, 2007.

(51) Int. Cl.

| | |
|---|---|
| ***B44F 7/00*** | (2006.01) |
| ***E04F 13/08*** | (2006.01) |
| ***E04D 1/00*** | (2006.01) |
| ***E04B 5/04*** | (2006.01) |

(52) U.S. Cl. ..... 52/385; 52/314; 52/554; 52/596; 52/597

(58) Field of Classification Search ..... 52/314, 52/315, 384, 385, 386, 390, 596, 597
See application file for complete search history.

(56) References Cited

U.S. PATENT DOCUMENTS

| | | | | |
|---|---|---|---|---|
| 2,924,963 | A * | 2/1960 | Taylor et al. | 52/509 |
| 4,160,346 | A | 7/1979 | Kaufmann | |
| 4,251,578 | A | 2/1981 | Kaufmann | |
| 4,287,241 | A | 9/1981 | Kaufmann | |
| 4,386,136 | A | 5/1983 | Kaufmann | |
| 5,062,913 | A | 11/1991 | Owens et al. | |
| 5,208,086 | A | 5/1993 | Owens | |
| 5,314,554 | A | 5/1994 | Owens | |
| 5,634,307 | A | 6/1997 | Larriberot et al. | |
| 5,836,572 | A * | 11/1998 | Sugiyama | 256/19 |
| 6,164,029 | A * | 12/2000 | Lee | 52/386 |
| 6,170,214 | B1 * | 1/2001 | Treister et al. | 52/511 |
| 6,315,489 | B1 * | 11/2001 | Watanabe | 403/381 |
| 6,913,645 | B2 | 7/2005 | McNulty, Jr. | |
| 7,159,367 | B1 * | 1/2007 | King | 52/314 |
| 2003/0066259 | A1 * | 4/2003 | Sudweeks | 52/506.05 |
| 2003/0084826 | A1 | 5/2003 | McNulty, Jr. | |
| 2003/0213212 | A1 * | 11/2003 | Passeno | 52/745.19 |
| 2004/0040239 | A1 | 3/2004 | Baillargeon | |
| 2005/0087908 | A1 | 4/2005 | Nast et al. | |
| 2005/0217192 | A1 | 10/2005 | Boosy | |
| 2006/0026919 | A1 | 2/2006 | Morse et al. | |
| 2006/0101752 | A1 | 5/2006 | Sakai et al. | |
| 2007/0045897 | A1 | 3/2007 | Alexander et al. | |
| 2007/0078191 | A1 | 4/2007 | Guhde et al. | |
| 2007/0130860 | A1 * | 6/2007 | Paquette et al. | 52/311.1 |

* cited by examiner

*Primary Examiner* — Brian Glessner
*Assistant Examiner* — Omar Hijaz
(74) *Attorney, Agent, or Firm* — Derek L. Prestin

(57) ABSTRACT

An artificial stone siding product for use as siding for homes, commercial buildings, and other structures, as well as for hearths, mantles, and other similar indoor structures, is provided. The artificial stone siding product includes a stone body cast of a cement aggregate and having an outer visible surface area shaped and colored to resemble real stone. An integral mounting support extends from at least one edge of the stone body. The mounting support allows the attachment of the artificial stone siding product to a surface of a wall using fasteners inserted through apertures defined by the support. The artificial stone siding product may be used to quickly and easily construct a stone wall by mounting a plurality of the artificial stone siding products to the exterior of a wall in much the same way as standard siding.

16 Claims, 4 Drawing Sheets

ARTIFICIAL STONE SIDING PRODUCT

CROSS-REFERENCE TO RELATED APPLICATION

This application is based upon and claims the benefit of U.S. Provisional Application Ser. No. 60/984,802, filed Nov. 2, 2007.

BACKGROUND OF THE INVENTION

The present invention is directed to an artificial stone siding product and, more particularly, to an artificial stone siding product for use as siding for homes, commercial buildings, and other structures, as well as for hearths, mantles, and other similar interior structures.

Artificial stones and bricks have been known for several years and several different methods exist for mounting these artificial stones and bricks. The most common system uses an artificial stone known as "manufactured stone," which is attached to the surface of a wall using mortar cement spread on a specially prepared surface using a trowel. In order for the mortar to adhere to the vertical surfaces of the wall, it is necessary to attach waterproof construction paper overlaid with metal mesh to the surface of the wall to provide a rough surface to hold the mortar in place. The consistency of the mortar used to attach the artificial stone is also important, as it must have sufficient thickness and tackiness to retain and hold the stones or bricks once the stones or bricks have been attached to the surface of the wall.

The manufactured stone artificial stones are generally fabricated with a fairly flat rear surface. The stones are held in place by placing the stone on the surface covered with the mortar and then applying pressure against the stone, thus creating suction between the mortar and the artificial stone that holds the stone in place until the mortar cures. However, when larger and heavier artificial stones are used, the weight of the stone will have a tendency to cause the stone to move, settle, or slide downward in the mortar as the mortar cures until it abuts an adjacent stone and must be repositioned. The artificial stones may also become detached from the wall and fall to the ground before the mortar completely cures, particularly when the environment in which the installation occurs increases the cure time of the mortar or interferes with the initial suction holding the stone to the wall.

To avoid these problems, nails or screws can be driven into the rigid backing structure behind the artificial stones to provide additional support to the stone and hold the stones in place until the mortar cures. However, driving the nails or screws in the proper locations to hold the stones is time-consuming and, once the mortar has set, the nails or screws must be removed, which may cause damage to the mortar and, unless the holes left by the removed nails or screws are filled, affect the aesthetics of the final wall.

A further disadvantage of this system is that it is not possible to construct a wall outdoors using the mortar and artificial stones when the weather is cold, snowy, rainy, or otherwise very damp, as such weather interferes with the setting of the mortar. In such weather it often is necessary to cover or shelter the mortar and artificial stones to shield the wall and the person constructing the wall from the weather, which adds time and cost to the process of building the wall.

A still further disadvantage of this system is that it is difficult to cover a large surface of a wall quickly unless the installer is experienced in mixing the proper consistency of the mortar and has developed expertise in selecting stone sizes, arrangements, and patterns that minimize slippage.

Significant experience and/or training is often necessary for an installer to install a large wall covered by the artificial stones. For the above reasons, this system has proven to be labor intensive, costly, and often inconvenient.

BRIEF SUMMARY OF THE INVENTION

It is a feature of the present invention to provide an artificial stone siding system and a method of constructing the same which substantially overcomes the above-mentioned disadvantages of the prior art.

More specifically, the present invention provides an artificial stone siding product that comprises a stone body cast of a cement artificial stone aggregate and having an outer visible surface area shaped and colored to resemble real stone or stones. The stone body has a substantially flat rear surface. An integral mounting support extends from the edge of the stone body to allow the attachment of the artificial stone siding product to a wall using nails, screws, or other similar fasteners. As such, the present invention does not require the use of mortar to attached the artificial stone siding to the wall or to hold adjacent artificial stones together.

According to a still further broad aspect of the present invention there is provided a method of fabricating a wall with artificial stones as above-described. The method comprises providing a plurality of artificial stones having a substantially flat rear surface and an integral mounting support extending from an edge of the stone body. The artificial stone is positioned at a desired position against a backing support surface of the wall. -The integral mounting support is then attached to and suspended from the surface of the wall through the use of fasteners extending through the integral mounting support and into the surface of the wall.

DETAILED DESCRIPTION OF THE PREFERRED EMBODIMENT(S)

Figure 1:
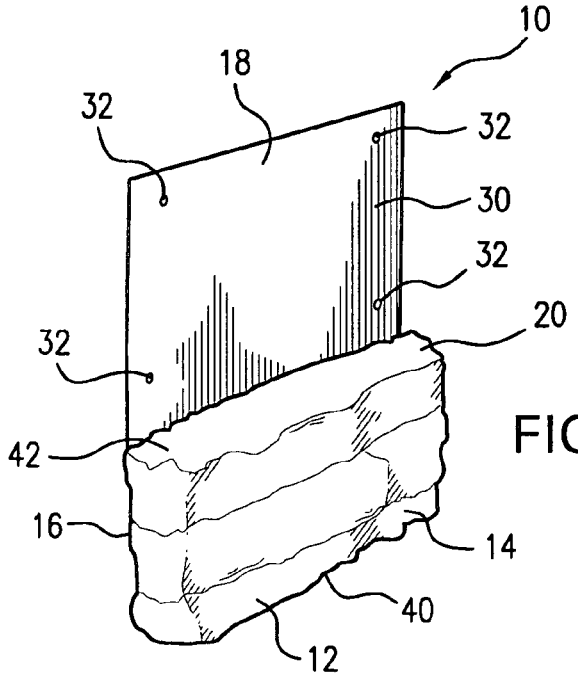
FIG. 1 is a perspective view of a artificial stone siding product embodying features of the present invention.
Figure 2:
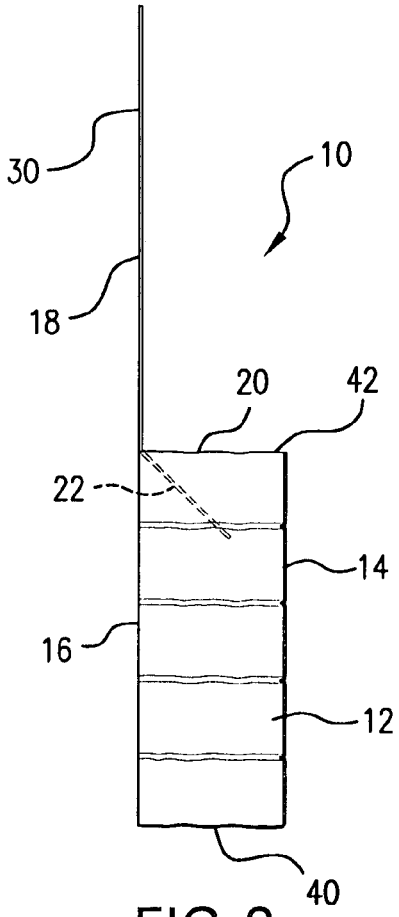
FIG. 2 is a side elevation view of the artificial stone siding product of FIG. 1.
Figure 3:
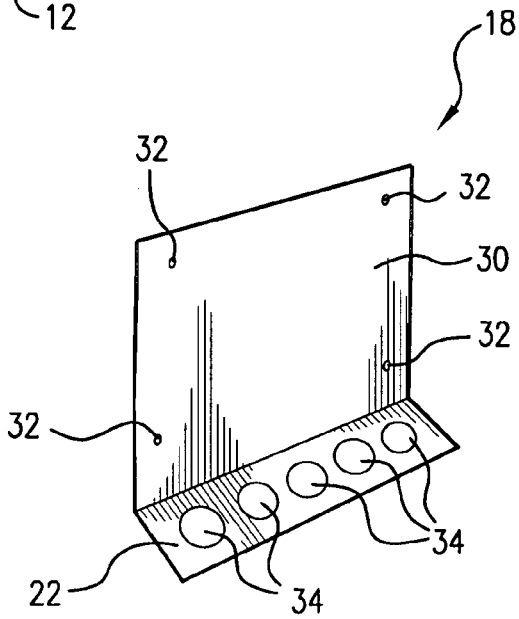
FIG. 3 is a perspective view of the artificial stone siding product of FIG. 1, with the stone body of the artificial stone siding product shown in shadow form to allow viewing of an anchor portion of the artificial stone siding product.

Referring now to the drawings and more particularly to FIGS. 1-3 there is shown an artificial stone siding product 10 which comprises a stone body 12 cast of a cement artificial stone aggregate and having a visible outer surface 14 extending in the front wall and sidewalls thereof that is shaped and colored irregularly to resemble real stone. The stone siding product 10 is cast in a rubber mold formed from a real stone or stones in order to imitate the surface of real stone. A colored pigment is also incorporated in the aggregate or applied to the outer surface 14 of the stone body 12 after casting to provide the artificial stone siding product 10 with coloration that also resembles natural stone.

Stone Body

The stone body 12 has a substantially flat rear inner surface 16 and an integral mounting support 18 extending from at least one edge 20 of the stone body 12.

The outer surface 14 of the stone body 12 is shaped and colored irregularly to resemble real stone. The outer surface may have a number of different configurations and may resemble bricks, fieldstone, slate, and many other similar types of real stone commonly used as an exterior building material.

The stone body 12 is generally produced by mixing a colored cement hardener having the desired stone color with cement. The cement used to produce the stone body 12 may be any cement generally known and used in the art. Preferably, the cement used to form the stone body 12 is any standard manufactured stone concrete-based cement that is used in the artificial stone industry and generally comprises water, sand, a light-weight aggregate, and other standard concrete ingredients and mixtures. The cement artificial stone aggregate used for the casting of the artificial stone siding product 10 is preferably a light density cement aggregate which includes polymeric particles which allows the mounting of the integral mounting support 18 therein without fragmenting the stone body 12.

The colored cement hardener is a colored pigment that is added to the stone body 12 to provide the artificial stone siding product 10 with coloration that resembles natural stone and also reduces the cure time of the cement. The cement mixture is then poured into a rubber mold on a vibrating table in order to remove air pockets or bubbles in the mixture as the cement cures. The rubber mold is preferably formed from a real stone or stones, or has a design that closely mimics real stone such that the outer surface 14 of the final stone body 12 resembles the surface of real stone. While the cement is still wet, the integral mounting support 18 is inserted into the stone body 12 with an angled anchor portion 22 inserted into the stone body. 12 such that the anchor portion 22 is beneath the surface of the stone body 12. The cement of the stone body 12 is then allowed to set and, in general, the cement takes approximately twenty-four hours to cure and set. However, either quick-setting cement having a short cure time, or other forms of cement with longer cure times, may be used to form the stone body 12. Once the cement of the stone body 12 has cured, the rubber mold is removed and the stone body 12 retains the shape provided by the rubber mold. If a colored cement hardener is not used to provide the stone body 12 with a stone color, a colored pigment may be applied to the outer surface 14 of the stone body after casting to provide the artificial stone siding product 10 with a coloration that resembles natural stone.

Although in FIGS. 1-3 the stone body 12 is shown as having a substantially rectangular or square configuration, the stone body 12 may have any shape known in the art. Likewise, although the stone body 12 is shown as being configured to resemble a combination of several different stones, such that the artificial stone siding product 10 represents several pre-assembled artificial stones, the stone body 12 may alternatively be configured to resemble just a single stone, such that each artificial stone siding product 10 represents only a single artificial stone.

Likewise, the dimensions of the stone body 12 may be any desired dimensions, provided that the integral mounting support 18 has sufficient strength to support the weight of the stone body 12. As is the case with other forms of artificial stone, the stone body 12 may have a variety or shapes, sizes, and configurations to allow for flexibility in the installation and use of the artificial stone siding product 10.

Although the stone body 12 disclosed and discussed herein is shown as having a configuration for use as a siding-type product, the stone body 12 may alternatively be configured as a sill or cap stone to provide a divider between the siding-type artificial stone siding product and the regular siding or other outer surface of the structure to which the artificial stone is attached, or may be configured to act as a utility, electrical, or water faucet box to surround the exterior utility access, electrical outlets, or water faucet of a building. Such artificial stone products are formed in the same way as the artificial stone siding product 10 discussed herein, but have the stone body configured in such a way as to act as a sill or cap stone or utility, electrical, or water faucet box.

Intergral Mounting Support

The integral mounting support 18 is integral to the stone body 12 and supports the weight of the artificial stone siding product 10 and allows it to be attached to a backing surface 24 of a wall 26 of the structure to which the artificial stone siding product is attached. The integral mounting support 18 is of generally rectangular shape and has dimensions that are sufficient to permit the integral mounting support 18 to be easily secured to the surface 24 of the wall 26 using fasteners 28.

The integral mounting support 18 includes a mounting portion 30 that extends from the edge of the stone body 12 and the angled anchor portion 22 that is substantially embedded within the interior structure of the stone body 12. The integral mounting support 18 is preferably one continuous piece of material, with the mounting portion 30 and anchor portion 22 being integral to each other. However, alternatively, the mounting portion 30 and anchor portion 22 may be two separate components that are attached to each other in some manner, such as through welding or with fasteners.

The mounting portion 30 of the integral mounting support 18 is preferably generally rectangular in shape and is configured in such a way that the mounting portion lies flat on the surface 24 of the wall 26 upon which the artificial stone siding product 10 is to be mounted. Preferably, the dimensions of the mounting portion 30 are similar to the dimensions of the stone body 12, but any dimensions that allow the integral mounting support 18 to provide support sufficient to allow the artificial stone siding product 10 to be permanently mounted on a wall 26 may be utilized.

The mounting portion 30 of the integral mounting support 18 defines one or more mounting apertures 32 sized to receive fasteners 28 for attaching the artificial stone siding product 10 to the surface 24 of the wall 26 upon which the artificial stone siding product 10 is to be mounted. Preferably, the integral mounting support 18 defines at least two mounting apertures 28, with the mounting apertures 28 located near the corners of the mounting portion 30 opposite the anchor portion 22. More preferably, the integral mounting support 18 defines at least four mounting apertures 28, with two mounting apertures 28 located near the corners of the mounting portion 30 opposite the anchor portion 22 and two mounting apertures 28 located near the corners of the mounting portion 30 adjacent the anchor portion 22, as may be seen in FIG. 1.

The mounting apertures 32 are sized to have dimensions that are sufficient to receive the fasteners 28 that are intended to be used to attach the artificial stone siding product 10 to the wall 26.

While the mounting apertures 32 are shown as being substantially circular in configuration, the mounting apertures 32 may have other alternative configurations. For example, the mounting apertures 32 may have a roughly rectangular or slot-type configuration, such that the artificial stone siding product 10 may be shifted slightly on the wall 26 once it has been mounted, in order to allow the artificial stone siding product 10 to be moved to its final position flush against the neighboring artificial stone siding products 10.

The anchor portion 22 is generally angled relative to the mounting portion 30. Preferably, the anchor portion 22 makes approximately a forty-five (45) degree angle relative to the mounting portion 30, as may be see in FIG. 3. However, the anchor portion 22 may alternatively have no angle relative to the mounting portion 30 or may make any other angle to the mounting portion 30.

The anchor portion 22 preferably defines at least one aperture 34. Preferably, the anchor portion defines a plurality of apertures 34, as may be seen in FIG. 3. The apertures 34 are sized such that the material from which the stone body 12 is made may flow through the apertures 34 when the stone body 12 is being formed and then harden therein, thereby holding the anchor portion 22 of the integral mounting support 18 fast within the stone body 12 and producing an artificial stone siding product 10 that a one-piece product. Although the apertures 34 are shown as having a substantially circular or elliptical configuration, the apertures 34 may alternatively have any other configuration, such as rectangular or slotted configurations. The apertures 34 may have any size that allows the cement of the stone body 12 to surround and set around the anchor portion 22. For example, the apertures 34 may have an elliptical configuration with a height of approximately 0.5 inch and a width of approximately 0.25 inch.

Although the use of the apertures 34 in the anchor portion 22 is preferred and discussed herein, the apertures 34 may optionally be omitted if the anchor portion 22 has a configuration that allows the structure of the anchor portion 22 itself to provide a means for anchoring the integral mounting support 18 to the stone body 12. For example, the apertures 34 may be omitted if the anchor portion 22 has a "V" or accordion-type configuration that allows the material from which the stone body 12 is made to flow into the valleys within the anchor portion 22 and secure the integral mounting support 18 within the stone body 12.

While the integral mounting support 18 is preferably constructed of a metal, such as aluminum or sheet metal, the integral mounting support 18 may alternatively be constructed of various materials such as another metal (including an alloy), a resin, a plastic, a woody material, ceramics, or a composite material. Preferably the material used to construct the integral mounting support 18 has affinity for the composition of the material used for the artificial stone body 12 and also exhibits excellent weather resistance, water resistance, strength, durability and the like.

The integral mounting support 18 is preferably semi-flexible and can be slightly bent in the flat plane thereof to allow the stone body 12 of the artificial stone siding product 10 to be positioned such that it is flush against the surface 24 of the wall 26. However, the integral mounting support 18 must also be rigid enough to support the weight of the stone body 12 without exhibiting deformation and to provide some level of back pressure to hold the stone body 12 flush against the surface 24 of the wall 26.

While the integral mounting support 18 discussed herein has a generally rectangular shape, the general shape and structure of the integral mounting support 18 may take alternative shapes and configurations as well. Likewise, although the, use of a single integral mounting support 18 is discussed herein, additional integral mounting supports may project from one or more of the other edges of the stone body 12 or a plurality of integral mounting supports may project from the same edge of the stone body 12.

Preferably, the stone body 12 and the integral mounting support 18 are constructed in such a way as to create a substantially waterproof artificial stone siding product 10 and, more specifically, to allow a plurality of artificial stone siding products 10 to be attached to a wall 26 as discussed herein to create a water-proof or water-resistant surface that may be exposed to precipitation and other weather without allowing water to reach the surface 24 of the wall 26 to which the artificial stone siding products 10 have been attached. In order to best allow a plurality of artificial stone siding products 10 to be attached to a wall 26 as discussed herein to create a water-proof or water-resistant surface, the width of the integral mounting support 18 is preferably at least one-half (½) the width of the stone body 12.

Fasteners

Any type of fastener 28 generally known in the art, such as screws, bolts, or nails, may be used to attach the artificial stone siding product 10 to the surface 24 of the wall 26. The fasteners 28 are inserted through the mounting apertures 32 in the mounting portion 30 of the integral mounting support 18. Preferably, the fasteners 28 are of the type generally used for exterior siding purposes and have improved resistance against the weather and water.

Depending upon the size and weight of the artificial stone siding product 10, and the construction of the surface 24 of the wall 26, fastener anchors, such as the plastic anchors that are commonly used to set anchors in gypsum walls and consisting of an anchoring cylinder body and an enlarged head flange having a hole therein to receive a fastener, may optionally be used to mount the artificial stone siding product 10 to the surface 24 of the wall 26. Although the fastener anchors generally used for such a purpose are most often constructed of a plastic material, the anchors may of course may be constructed of other types of material such as metal or wood.

Mounting

Figure 4:
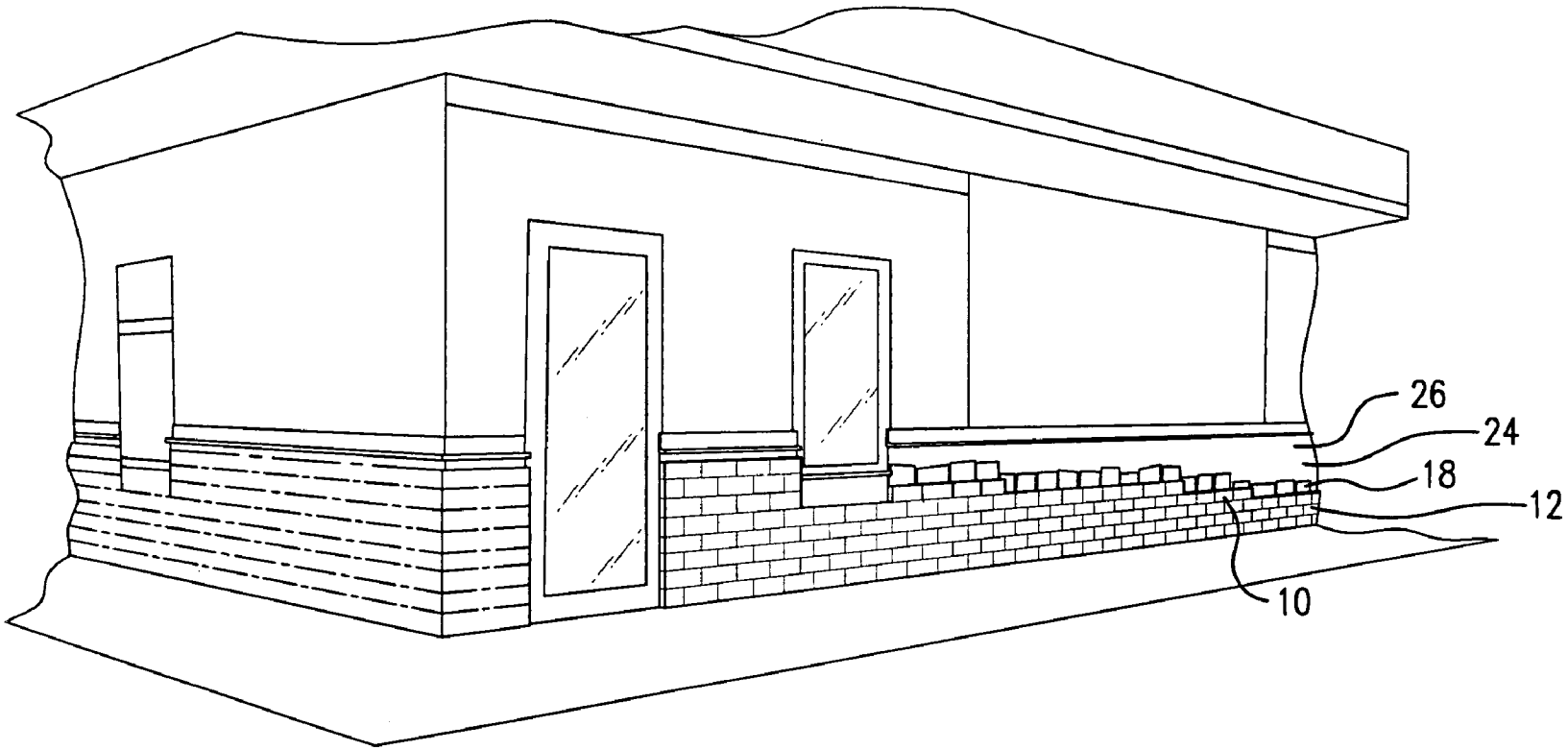
FIG. 4 is a perspective view of a wall to which a plurality of the artificial stone siding products of FIG. 1 have been attached.
Figure 5:
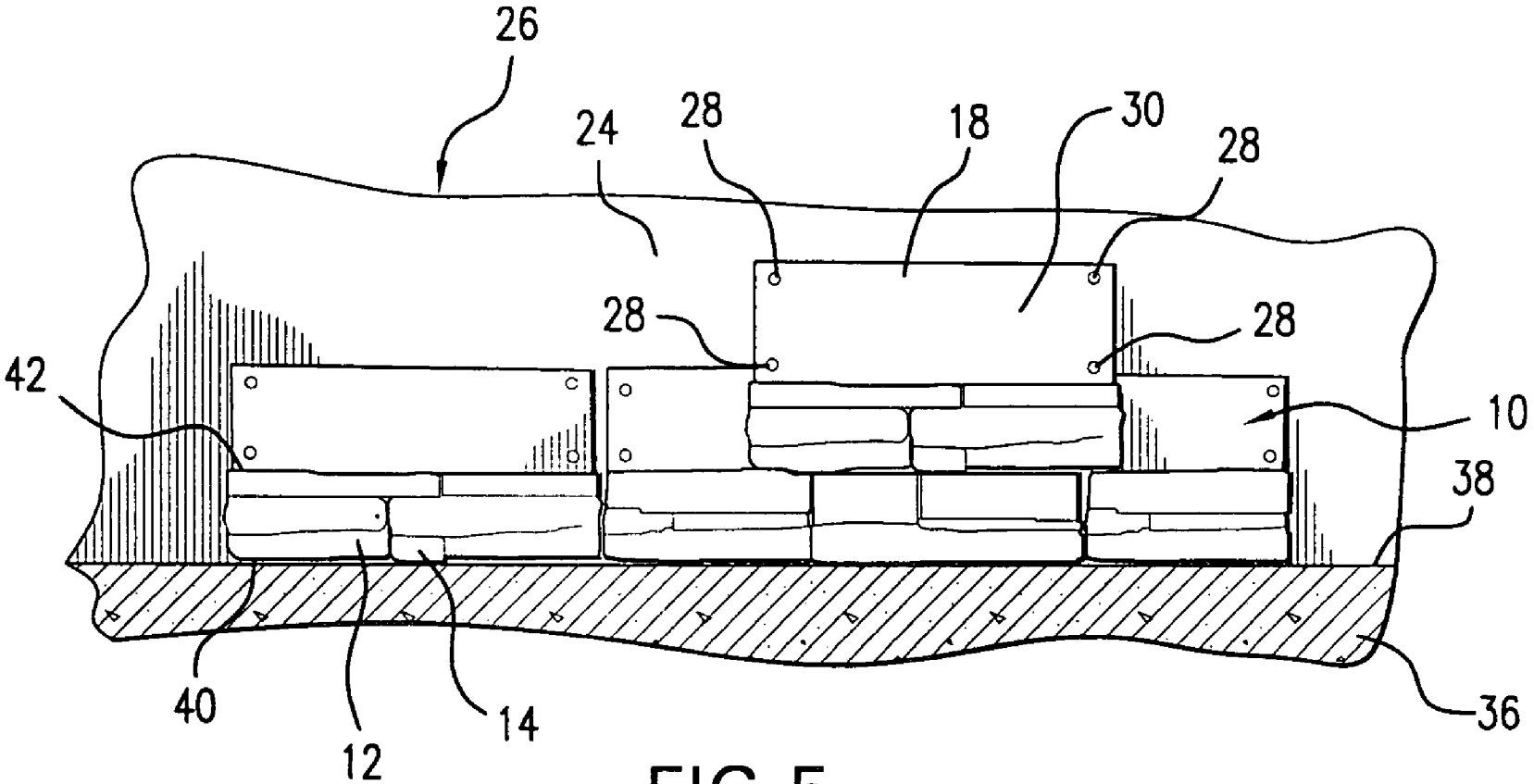
FIG. 5 is a front elevation view of a wall to which a plurality of the artificial stone siding products of FIG. 1 have been attached.
Figure 6:
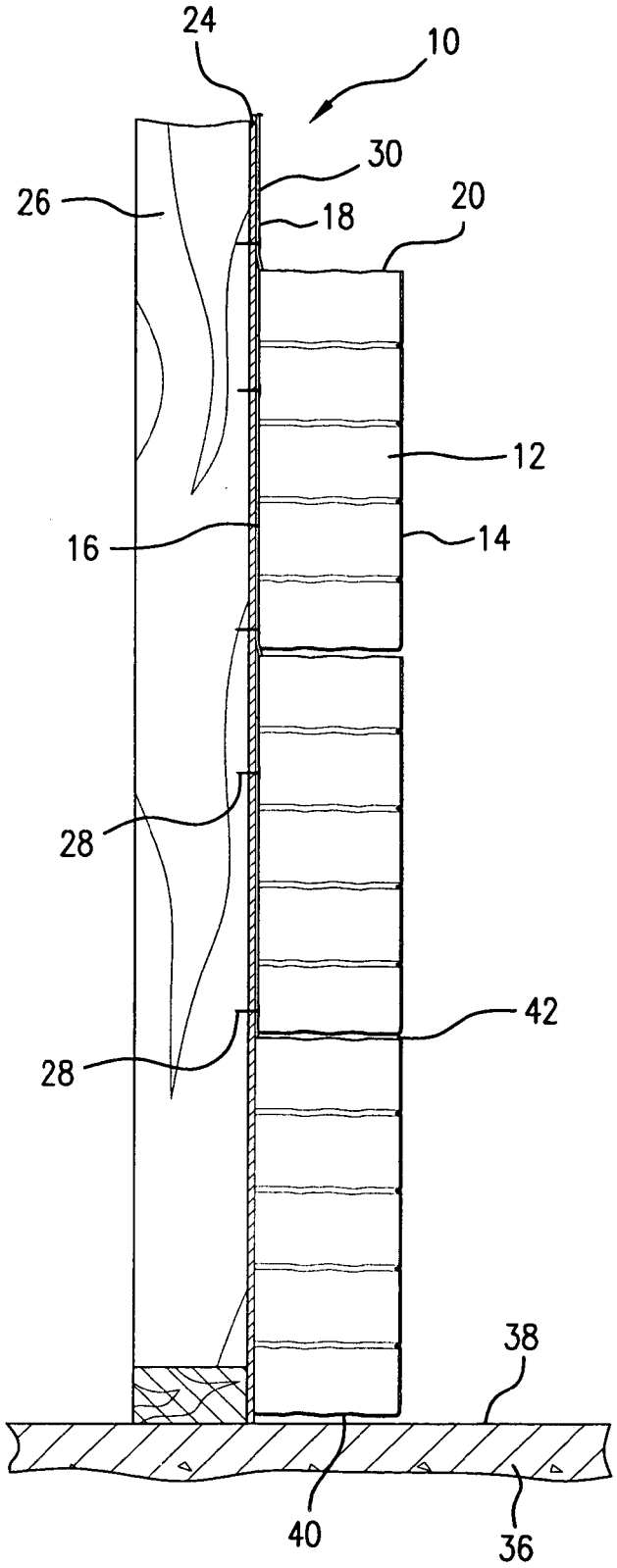
FIG. 6 a side elevation view of a wall to which a plurality of the artificial stone siding products of FIG. I have been attached.

Referring now to FIGS. 4-6 there is shown the manner in which the artificial stone siding product 10 is secured to the exterior building surface 24 of the wall 26. The exterior wall 26 is provided with the backing surface 24, generally a plywood sheet or other similar material, into which the fasteners 28 may be driven and secured. The backing surface 24, if necessary, may have conventional waterproofing and vapor barrier sheeting secured to its surface, since such materials do not interfere with the use of the fasteners 28.

As shown in FIGS. 4 and 6, the exterior building wall 26 is often disposed on a foundation 36 which may be provided with a lip 38 for receiving a brick or stone wall thereover. While such a lip 38 is often provided during the construction of the foundation 36, with the system of the present invention such a lip 38 is not required since the artificial stone siding product 10 is supported by the integral mounting support 18.

In order to secure and mount the artificial stone siding product 10 on the wall 26, the installer places the artificial stone siding product 10 in the proper position on the wall 26 with the integral mounting support 18 above the stone body 12. If the artificial stone siding product 10 is part of the lowest row of siding, a bottom edge 40 of the artificial stone siding product 10 may rest on the lip 38 of the foundation 36. Likewise, if the artificial stone siding product 10 is part of a higher row of siding, the bottom edge of the artificial stone siding product 10 may rest on the upper edge 42 of the artificial stone siding products 10 in the row just below that artificial stone siding product 10. The installer then holds the integral mounting support 18 against the backing surface 24 of the wall 26 and drives the fasteners 28 being used, such as nails, through the mounting apertures 32 and into the backing surface 26. Once the fasteners 28 have been driven into the backing surface 24, the artificial stone siding product 10 is fully secured to the wall 26 and the installer may move on and attach the next artificial stone siding product 10 to the wall 26.

In general, a plurality of artificial stone siding products 10 will be attached to a wall 26. FIGS. 4-6 show several artificial stone siding products 10 secured to the backing surface 24 of the wall 26 and, as shown, the artificial stone siding products 10 can be installed over the entire surface to be covered in a very quick manner as the only thing necessary is to position the artificial stone siding product 10 at a desired location with proper spacing and then insert fasteners 28, such as a nails or screws, within each of the mounting apertures 32 of the integral mounting support 18 to attach the artificial stone siding products 10 to the backing surface 24.

Preferably, when a plurality of artificial stone siding products 10 are used to cover a wall 26, each row of artificial stone siding products 10 is offset from the row just below it by a distance of approximately one-half (½) the width of the artificial stone siding product 10. Such a configuration prevents the seams between neighboring artificial stone siding products 10 from vertically lining up, thereby increasing the water resistance of the wall 26 covered by the artificial stone siding products 10. While it is preferable, for aesthetic purposes, that the offset distance by approximately one-half (½) the width of the artificial stone siding product 10, any distance that prevents the seams between neighboring artificial stone siding products 10 from lining up vertically may alternatively be used.

Optionally, in order to further improve the water resistance of the wall 26, a rubber or tar paper flashing may be used to cover the integral mounting supports 18 of the artificial stone siding product 10. The flashing is mounted such that it covers one or more the of the integral mounting supports 18 of a row of the artificial stone siding product 10. In general, a row of the artificial stone siding products 10 is mounted on the wall 26 and then a strip of the flashing is mounted just above the row of artificial stone siding products 10 and covers the integral mounting supports 18 of the row. The flashing may be mounted on the wall 26 in any way known in the art, preferably using staples, nails, or similar fasteners. The next row of artificial stone siding products 10 is then mounted over the flashing, such that the flashing is forms a water resistant barrier between the stone body 12 of the artificial stone siding product 10 of the higher row and the integral mounting support 18 of the artificial stone siding product 10 of the lower row.

If the optional flashing is used to cover the integral mounting supports 18, the integral mounting supports 18 may be smaller and shorter than otherwise necessary to provide a water resistant surface using the artificial stone siding product 10, thereby reducing the cost of the artificial stone siding product 10.

Summarizing, the method of fabricating a wall having stone surface area with these artificial stone siding products 10 consists of providing a plurality of these artificial stone siding products 10 with a flat rear surface 16 and each having an integral mounting support 18 which may be attached to the backing surface 24 of a wall 26 through the use of fasteners 28. These artificial stone siding products 10 are positioned at desired positions against a backing support surface 24 and the integral mounting supports 18 are secured to this backing support surface 24 by fasteners 28 to suspend the artificial stone siding products 10 from the wall 26.

General

While the invention has been described in the specification and illustrated in the drawings with reference to certain preferred embodiments, it will be understood by those skilled in the art that various changes may be made and equivalents may be substituted for elements thereof without departing from the scope of the present invention as defined in the appended claims. In addition, many modifications may be made to adapt a particular situation or material to the teachings of the invention, as defined in the appended claims, without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the appended claims.

What is claimed is:

1. An artificial stone product comprising:

a stone body cast of a cement aggregate having an outer visible surface area shaped and colored to resemble a real stone and having a substantially flat inner surface;

a mounting support, wherein the mounting support includes a substantially flat mounting portion that extends only from an upper edge of the stone body and an anchor portion that is embedded within the stone body to secure the mounting support to the stone body and that has a width that is substantially equal to the width of the stone body, wherein the mounting portion of the mounting support extends from the stone body a distance that is at least equal to the distance between a bottom edge of the stone body and a top edge of the stone body, wherein the mounting portion and anchor portion are angled relative to each other, and wherein the mounting support comprises one continuous piece of material, and wherein the mounting portion of the mounting support defines at least two apertures for receiving fasteners for attaching the artificial stone siding product to a surface of a structure and wherein, when the artificial stone product is attached to the surface of the structure, the mounting portion is configured to lie substantially flat on the surface of the structure upon which the artificial stone product is mounted and the mounting portion receives a substantially flat inner surface of a stone body of a second artificial stone product installed above a first artificial stone product.

2. The artificial stone product of claim 1 wherein the anchor portion of the mounting support defines at least one aperture through which the cement aggregate extends after setting to secure the mounting support to the stone body.

3. The artificial stone product of claim 1 wherein the cement aggregate is a manufactured stone concrete.

4. The artificial stone product of claim 1 wherein the stone body is configured to resemble at least one stone.

5. The artificial stone product of claim 1 wherein the stone body is configured to resemble a plurality of stones.

6. The artificial stone product of claim 1 wherein the stone body is configured as a siding product.

7. The artificial stone product of claim 1 wherein the mounting portion of the mounting support has a width that is substantially equal to the width of the stone body.

8. The artificial stone product of claim 1 wherein the stone body has a substantially square or rectangular configuration.

9. The artificial stone product of claim 1 wherein the stone body is colored to resemble a real stone using a pigment added to the cement aggregate.

10. The artificial stone product of claim 1 wherein the cement aggregate is colored to resemble a real stone using a pigment applied to the surface of the stone body.

11. The artificial stone product of claim 1 wherein the mounting portion comprises aluminum.

12. The artificial stone product of claim 1 wherein the mounting portion comprises sheet metal.

13. The artificial stone product of claim 1 wherein the mounting portion comprises a plastic.

14. The artificial stone product of claim 1 further comprising at least one fastener, wherein the fastener extends through the mounting portion of the mounting support to secure the artificial stone siding product to a structure.

15. The artificial stone product of claim 14 wherein the fastener is a nail fastener.

16. The artificial stone product of claim 14 wherein the fastener is a screw fastener.

* * * * *